US006473982B1

(12) United States Patent
Schimes

(10) Patent No.: US 6,473,982 B1
(45) Date of Patent: Nov. 5, 2002

(54) DEPTH AND MITER GAUGE

(76) Inventor: James Schimes, 629 Clay Ave., Scranton, PA (US) 18510

( * ) Notice: Subject to any disclaimer, the term of this patent is extended or adjusted under 35 U.S.C. 154(b) by 70 days.

(21) Appl. No.: 09/665,386

(22) Filed: Sep. 20, 2000

(51) Int. Cl.[7] ..... B43L 13/20; B43L 7/033
(52) U.S. Cl. ..... 33/562; 33/194
(58) Field of Search ..... 33/411, 429, 474, 33/480, 481, 482, 194, 562, 563, 566

(56) References Cited

U.S. PATENT DOCUMENTS

| | | | | | |
|---|---|---|---|---|---|
| 387,966 | A | * | 8/1888 | Beckwith | 33/429 |
| 810,246 | A | | 1/1906 | Anderson | |
| 1,048,333 | A | | 12/1912 | Mishler | |
| 1,125,010 | A | * | 1/1915 | Doner | 33/481 |
| 2,000,773 | A | * | 5/1935 | McGlauflin | 33/474 |
| 3,986,418 | A | | 10/1976 | Lang et al. | |
| 5,203,090 | A | | 4/1993 | Bouska et al. | |
| 5,678,367 | A | | 10/1997 | Kline | |

* cited by examiner

*Primary Examiner*—Christopher W. Fulton
(74) *Attorney, Agent, or Firm*—Cummings & Lockwood

(57) ABSTRACT

A depth and miter gauge is provided for easily and accurately marking lines on a piece of trim, such as J-channel trim, so that the trim can be appropriately cut to make a mitered joint. The depth and miter gauge generally includes a web having a first slot defining a first edge adjacent a first end of the web for making depth markings on the trim, and a first flange extending approximately perpendicularly from a first side of the web and having a mitered edge on each end thereof for making miter markings on the trim. The gauge may also include a second slot defining a second edge adjacent a second end of the web for making depth markings on the trim, and a second flange extending approximately perpendicularly from a second side of the web, in a direction opposite the first flange, and having a mitered edge on each end thereof for making miter markings on the trim.

20 Claims, 4 Drawing Sheets

DEPTH AND MITER GAUGE

FIELD OF THE INVENTION

The present invention relates generally to a depth and miter gauge for marking trim, and, more particularly, the present invention relates to a depth and miter gauge for accurately marking J-channel trim so that a user may make mitered joints on J-channel frames.

BACKGROUND OF THE INVENTION

When installing vinyl or aluminum siding on a house or a building, it is desirable to install J-channel trim around the doors and windows of the house so to neatly retain the edges of the siding. In addition to retaining the edges of the siding, J-channel trim provides a finished appearance to the siding job.

Properly installed J-channel trim requires accurately marked and cut miter joints. Using currently available tools it can be awkward and time consuming to accurately mark and cut such miter joints. For example, to make a miter joint a worker will typically use a measuring tape, combination square, and a pencil to mark the J-channel trim and will cut the trim with aviation snips. Those skilled in the art will appreciate that existing methods for marking J-channel trim can be unsafe when working on ladders or scaffolding.

Tools have been disclosed for creating various types of cut lines for specialized circumstances. For example, U.S. Pat. No. 1,048,333 to Mishler discloses a square suited for creating mortises. By using the Mishler square, a user can draw on a piece of timber the side-lines around which a mortise can be created. The Mishler square, however, does not provide for marking miter cuts. Furthermore, the Mishler square is sufficiently large so that it is not conveniently carried while climbing a ladder or while traversing a scaffold.

U.S. Pat. No. 5,203,090 to Bouska et al. discloses a siding layout tool and a method for making a longitudinal mark on, or a cut through, a piece of siding. The tool includes an upper plate portion and a lower plate portion with a step there between, which is adapted to fit onto a piece of siding having an upper panel and a lower panel, with a ridge there between. The upper and lower plate portions each have a series of openings in predetermined locations along the length of the tool. To make a mark on the siding, a pencil is placed through a selected one of the openings, and the tool and pencil are moved along the siding while maintaining the step in engagement with the ridge of the trim. Disadvantageously, however, the Bouska et al. tool must be slid along the edge of a piece of siding to mark a line thereon, which can be cumbersome. In addition, the Bouska et al. tool does not allow a user to mark mitered cut lines on corresponding pieces of J-channel trim for creating a mitered joint.

What is desired, is a tool for accurately marking the necessary cut lines upon, for example, pieces of J-channel trim such that a mitered joint can be easily made. In addition, the tool should be relatively easy to carry and easy to use.

SUMMARY OF THE INVENTION

Accordingly, the present invention provides a depth and miter gauge for easily and accurately marking cut lines upon a piece of trim, such as J-channel trim, so the trim can be cut to form a mitered joint. The depth and miter gauge includes a web having a first slot defining a first edge and a second edge that are spaced approximately 0.75 inch and 1.15 inches, respectively, from a first end of the web. The depth and miter gauge also includes a second slot defining a third edge and a fourth edge that are spaced approximately 0.75 inch and 1.15 inches, respectively, from a second end of the web. The first, second, third, and fourth edges are used for making depth markings on J-channel trim.

In addition, the depth and miter gauge includes a first flange extending approximately perpendicular from a first side of the web. The first flange has a first mitered edge angled approximately 45 degrees relative to the first side of the web. The first flange also has a second mitered edge angled approximately 45 degrees relative to the first side of the web. The first and second mitered edges of the first flange are used for making miter markings on J-channel trim.

An embodiment of the present invention also includes a second flange extending approximately perpendicularly from a second side of the web in a direction opposite the first flange and having a first mitered edge angled approximately 45 degrees relative to the second side of the web. The second flange also has a second mitered edge angled approximately 45 degrees relative to the second side of the web. The first and second mitered edges of the second flange are used for making miter markings on J-channel trim.

An embodiment of the present invention also includes a method for making mitered joints on J-channel trim. The method includes providing a depth and miter gauge which includes a web having a slot defining a first edge adjacent and parallel with an end of the web for making depth markings on the trim, and a first flange extending approximately perpendicularly from a first side of the web and having a mitered edge on its first end for marking cut lines on the trim.

In the method for using the depth and miter gauge, the web is placed on a base of the trim with the end of the web held flush with an end of the trim. A mark is then made on the base of the trim along the first edge of the gauge. The depth and miter gauge is then relocated so its first flange rests on a front leg of the trim with the end of the web held flush with the end of the trim. A mark is then made on the front leg of the trim along the mitered edge of the gauge. The first flange is then rested against the rear leg of the trim with the end of the web held flush with the end of the trim. A mark is then made on the rear leg of the trim along the mitered edge of the gauge. The lines are then cut using, for example, aviation snips, and the cut portions discarded.

These and other unique features of the present invention will become more readily apparent from the drawings, the description of the drawings, and the detailed description of the invention provided herein below.

BRIEF DESCRIPTION OF THE DRAWINGS

So that those of ordinary skill in the art to which the subject invention pertains will more readily understand how to make and use the device and method described herein, embodiments of the invention will be described in detail with reference to the drawings, wherein.

DETAILED DESCRIPTION OF THE INVENTION

Reference is now made to the accompanying Figures for the purpose of describing, in detail, embodiments of and methods of using the present invention. The Figures are provided as examples of the invention and are not intended to limit the scope of the claims appended hereto.

Figure 1:
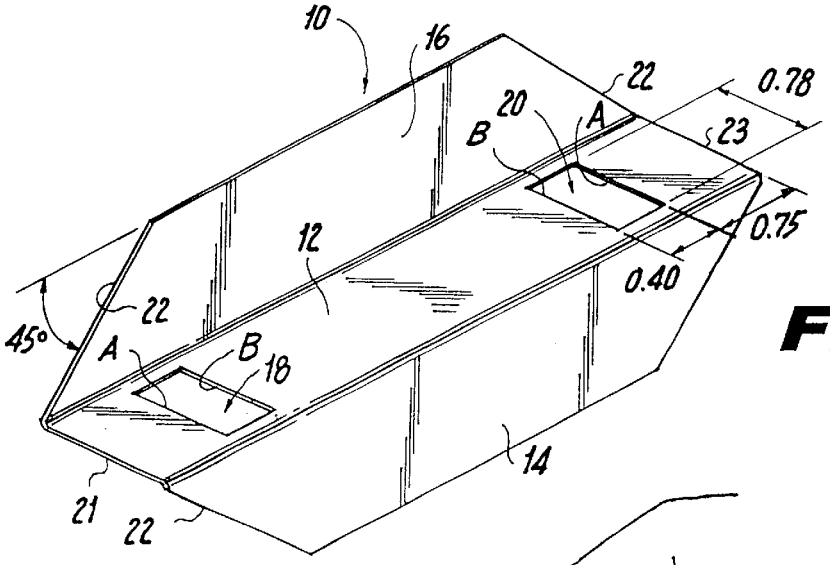
FIG. 1 is an isometric view of an embodiment of a depth and miter gauge made in accordance with the present invention.

FIG. 1 is an isometric view of an embodiment of a depth and miter gauge 10 made in accordance with the present invention. The gauge 10 is a hand held tool used to mark, for example, J-channel trim when installing such trim on structures having aluminum or vinyl siding. The gauge 10 can be made of various materials such as metal or plastic and may be manufactured by stamping and bending, extruding, machining, lock forming, molding, and casting. It is notable that although the present invention is described herein as a tool for marking J-channel trim, embodiments of the present invention may also be made for marking other types of trim and attachments. Those of ordinary skill in the art will appreciate that standard J-channel trim is available in ⅝ inch and 1⅛ inch sizes—the dimension defining the measurement across the opening of the base portion of the trim.

The gauge 10 includes a web 12 from which a first flange 14 and a second flange 16 extend. The web 12 is generally rectangular in shape and includes a slot adjacent each of its ends. The first slot 18 measures 0.78 inch×0.40 inch and is 0.75 inch from a first end 21 and the second slot 20 also measures 0.78 inch×0.40 inch and is 0.75 inch from a second end 23. Each slot 18 and 20 defines a first edge "A" and a second edge "B". The slots 18 and 20 are sized and positioned on the web 12 to enable a user to accurately mark a base of standard ⅝ inch J-channel trim using edge "A" or 1⅛ inches J-channel trim using edge "B."

Flange 14 extends approximately perpendicularly from a first side of the web 12 and includes a mitered edge 22 on each end that is angled 45 degrees relative to the first side of the web 12. Flange 16 extends approximately perpendicularly from a second side of the web 12 in a direction opposite flange 14 and includes a mitered edge 22 on each end that is angled 45 degrees relative to the second side of the web 12. The depth and meter gauge 10 has a substantially Z-shaped cross-section.

The gauge 10 may be used to facilitate making accurate miter cuts, straight cuts, and interlocking tabs in J-channel trim. Such modifications to J-channel trim permit a user to readily make a variety of interlocking J-channel frames. For example, to make a four-sided frame around a window (i.e., an outside J-channel frame) or around an area of siding (i.e., an inside J-channel frame), a user may cut two pieces of J-channel trim, each piece having opposing miter cuts on each end (the direction of which determining whether the frame is an outside or inside J-channel frame) and two pieces of J-channel trim with a straight cut and interlocking tab on each end. After the four pieces of J-channel trim are prepared, they are positioned in interlocking relationship around the window or around the area of siding, respectively, and nailed into place. Of course, a similar process may be used to make a three-sided J-channel frame around, for example, a door.

Figure 2:
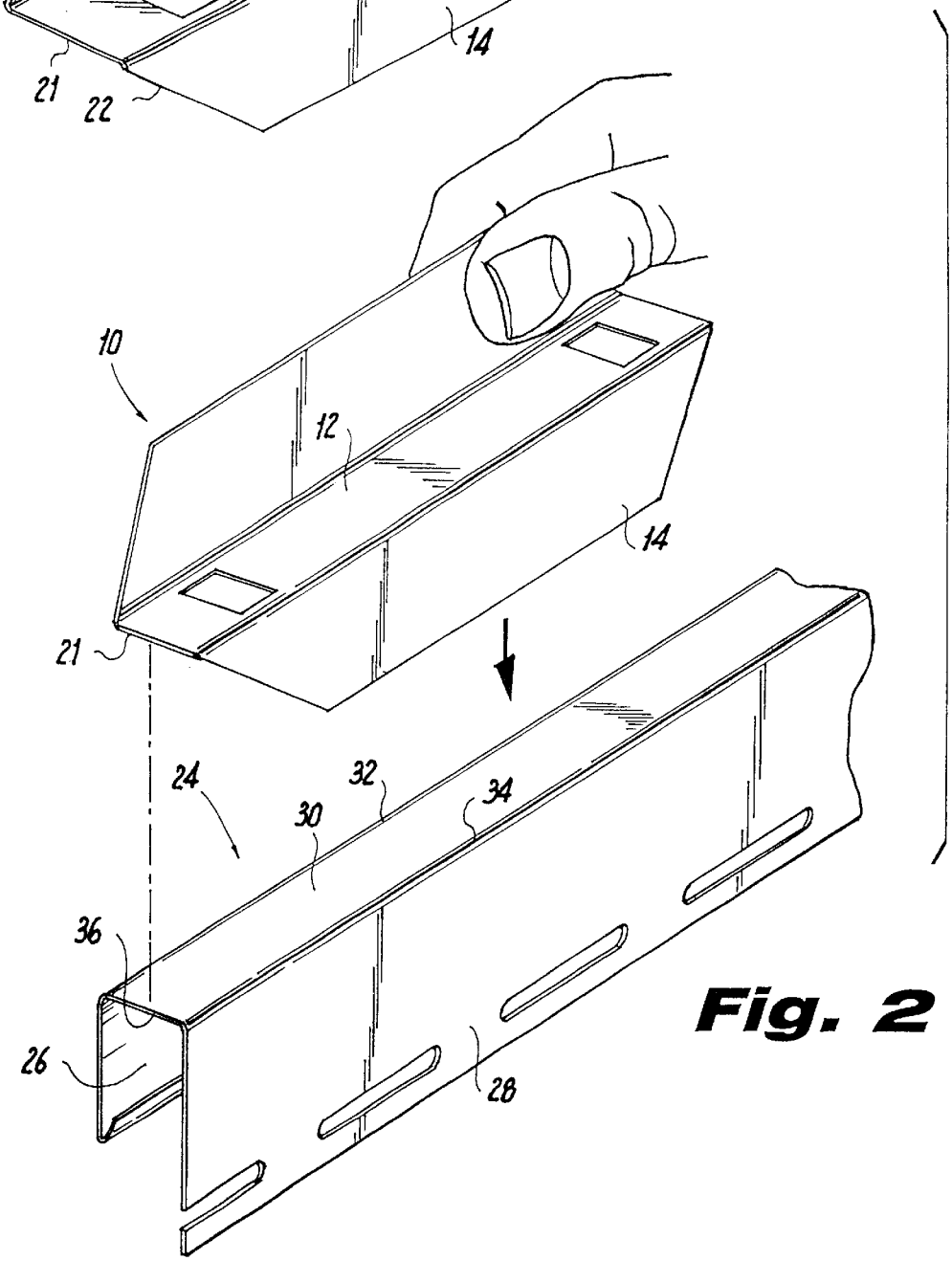
FIGS. 2–4 are isometric views illustrating a method for using the depth and miter gauge illustrated in FIG. 1 to mark cut lines on a piece of J-channel trim that is to be used to make miter joints for an outside J-channel frame.
Figure 3:
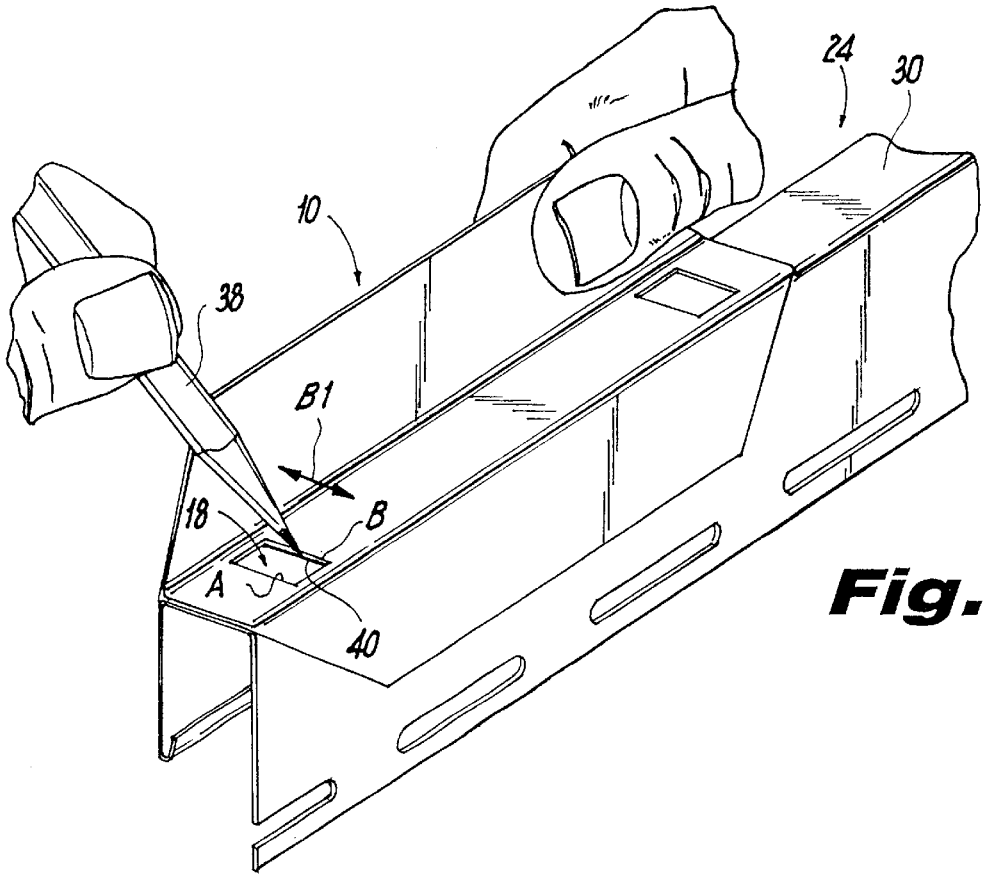
Figure 4:
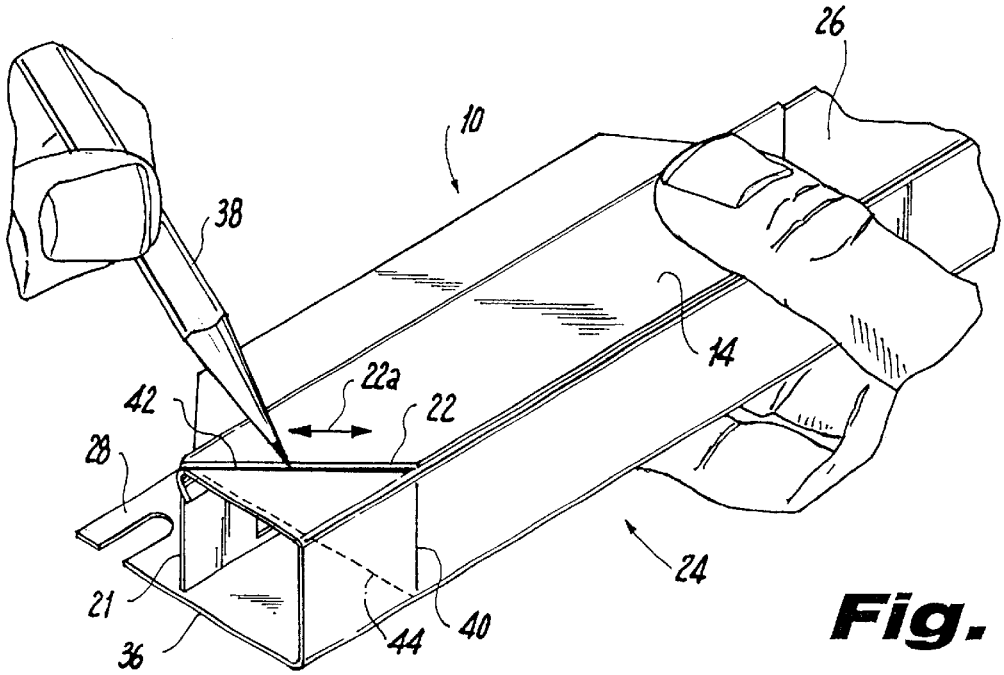

FIGS. 2–4 illustrate using gauge 10 to mark an end of a piece of 1⅛ inch J-channel trim 24 that is to be used as part of an outside J-channel frame. Referring to FIG. 2, a user cuts the piece of J-channel trim 24 to a desired length. The piece of J-channel trim 24 includes a front leg 26 and a rear leg 28 extending from opposite sides of a channel base 30. The legs 26, 28 and base 30 define comers 32 and 34 and squared end 36.

In use, a user places the web 12 of gauge 10 against the base 30 of the J-channel trim 24 so that flange 14 of gauge 10 rests against the rear leg 28 of the J-channel trim 24 and end 21 of gauge 10 is flush with end 36 of the J-channel trim 24.

Referring to FIG. 3, with gauge 10 in position on J-channel trim 24, the user takes a scoring or marking instrument, for example a pencil 38, and makes a mark on the base 30 of J-channel trim 24 along edge "B" of slot 18 as indicated by arrow B1 to form line 40. As noted above, edge "A" of slot 18 is used for marking the base of ⅝ inch J-channel trim.

Referring to FIG. 4, the user relocates gauge 10 in relation to J-channel trim 24 so that flange 14 rests against the front leg 26 of J-channel trim 24 and end 21 of gauge 10 is flush with end 36 of J-channel trim 24. The user makes a mark on the front leg 26 along mitered edge 22 of gauge 10 as indicated by arrow 22*a* to form line 42.

Using a straight edge of gauge 10, the user may also make a mark on the rear leg 28 of J-channel trim 24 to form a line 44 that is approximately perpendicular with line 40. The gauge 10 is then removed and put aside.

Figure 5:
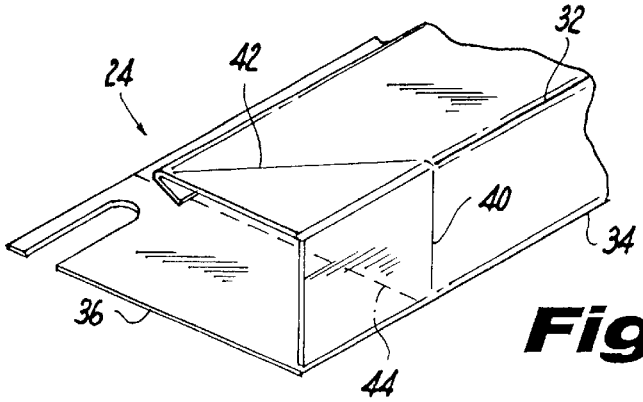
FIGS. 5 and 6 are isometric views illustrating a progression of cuts in the J-channel trim that was marked following the method illustrated in FIGS. 2–4.
Figure 6:
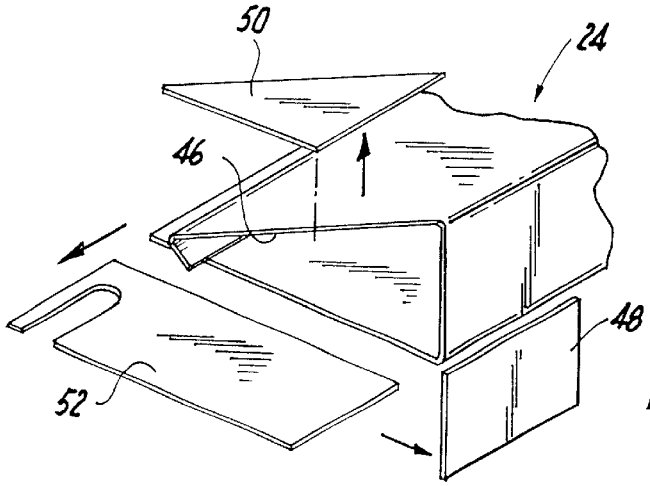

Referring to FIGS. 5 and 6, the user cuts from end 36 along comers 32 and 34 of J-channel trim 24 up to line 40 using aviation snips. Thereafter, the user cuts along lines 40, 42, and 44; thereby, defining mitered end 46 of J-channel trim 24. The resulting scrap pieces 48, 50, and 52 may be discarded.

To complete the preparation of a mitered piece of J-channel trim for use in an outside J-channel frame, the process described above and illustrated in FIGS. 2–6 is repeated on the opposite end of J-channel trim 24. Thereafter, a second piece of J-channel trim, identical to mitered J-channel trim 24, is prepared for the opposite side of the outside J-channel frame.

To create a straight-cut piece of J-channel trim having interlocking tabs, the user proceeds as described above and illustrated in FIGS. 2, 3, and 5 on both ends of a piece of J-channel trim that has been cut to a desired length. It is notable that an interlocking tab (cut off as scrap piece 48 in the mitered pieces of J-channel trim described above) is formed on each end of the straight-cut piece of J-channel trim. Thereafter, a second straight-cut piece of J-channel trim, identical to the first piece, is prepared for the opposite side of the outside J-channel frame.

Figure 7:
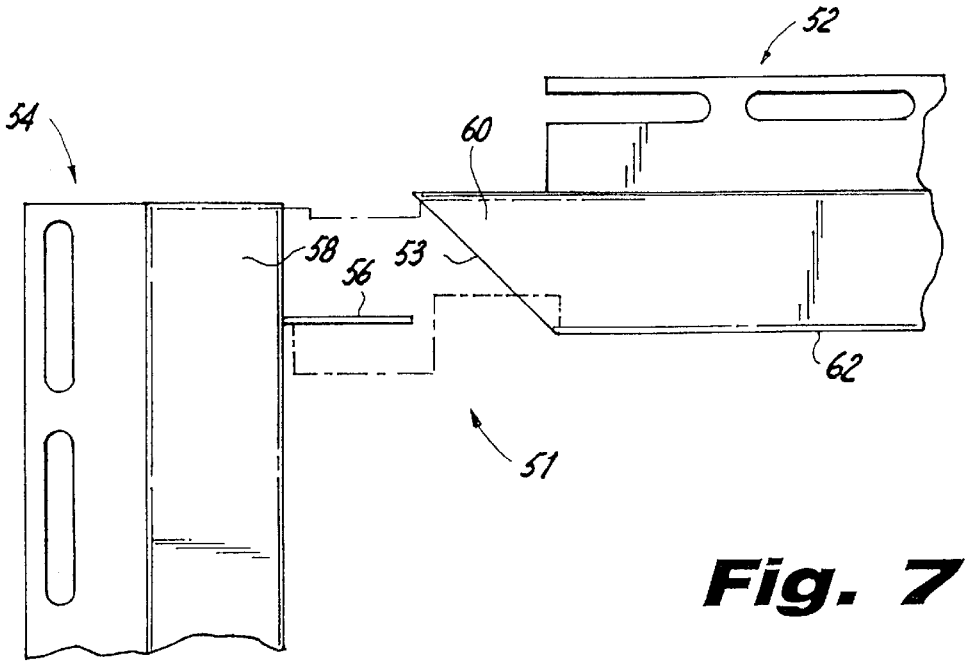
FIG. 7 is a front view of a mitered piece of J-channel trim and a straight-cut piece of J-channel trim being assembled to make an outside J-channel frame.

Referring to FIG. 7, a front view of a mitered joint 51 of an outside J-channel frame is shown which includes a mitered piece of J-channel trim 52 having a mitered end 53 and a straight-cut piece of J-channel trim 54 having an interlocking tab 56. To assemble the mitered joint 51, the front leg 58 of straight-cut J-channel trim 54 is slid behind the front leg 60 of the mitered piece of J-channel trim 52, and the interlocking tab 56 of the straight-cut piece of J-channel trim 54 is slid along the channel base 62 of the mitered piece of J-channel trim 52. After assembly, both pieces of J-channel trim 52 and 54 can be nailed in place. Due to the overlap of front leg 60 over front leg 58, the two surfaces will be slightly uneven.

To complete the outside frame, a second mitered piece of J-channel trim and a second straight-cut piece of J-channel trim are made and assembled as described above and nailed into place. The above combination of mitered pieces of J-channel trim and straight-cut pieces of J-channel trim are convenient to use when, for example, the outside J-channel frame cannot be assembled square and, therefore, a gap would form if only mitered pieces of J-channel trim (described below) were used.

Figure 8:
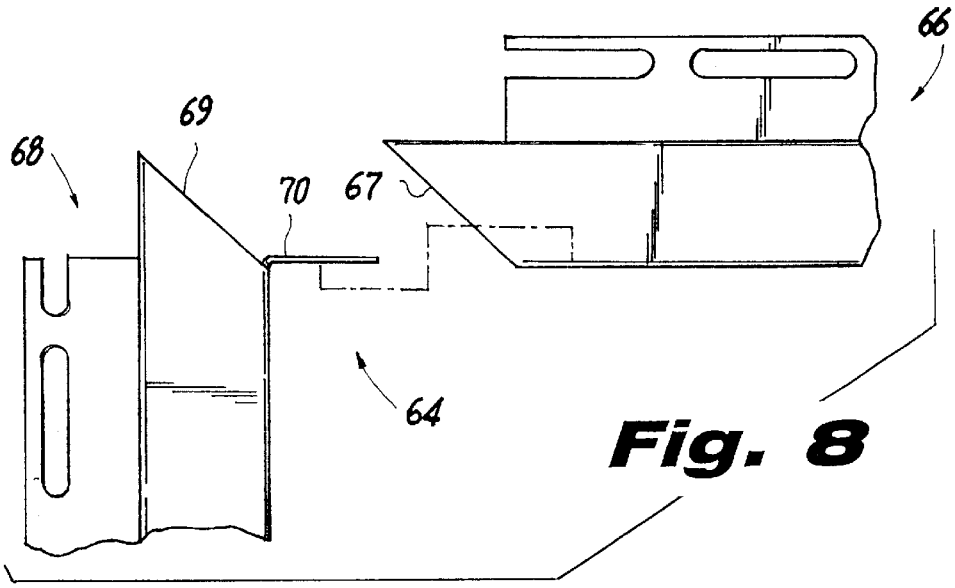
FIG. 8 is a front view of two mitered pieces of J-channel trim being assembled to make an outside J-channel frame.

FIG. 8 shows a mitered joint 64 of an outside J-channel frame which was marked using an embodiment of the present invention, for example, gauge 10. Mitered joint 64 is similar to mitered joint 51 shown in FIG. 7; however, instead of using a mitered piece of J-channel trim 52 and a straight-cut piece of J-channel trim 54, both pieces of J-channel trim 66 and 68 have mitered cuts 67 and 69, respectively, and J-channel trim 68 further includes an interlocking tab 70. The advantage of mitered joint 64 over mitered joint 51 is that it tends to have a neater appearance since there is no step between the two. However, the J-channel trim pieces of mitered joint 64 must be assembled square, otherwise a gap will form between the mitered cuts 67 and 69.

Figure 9:
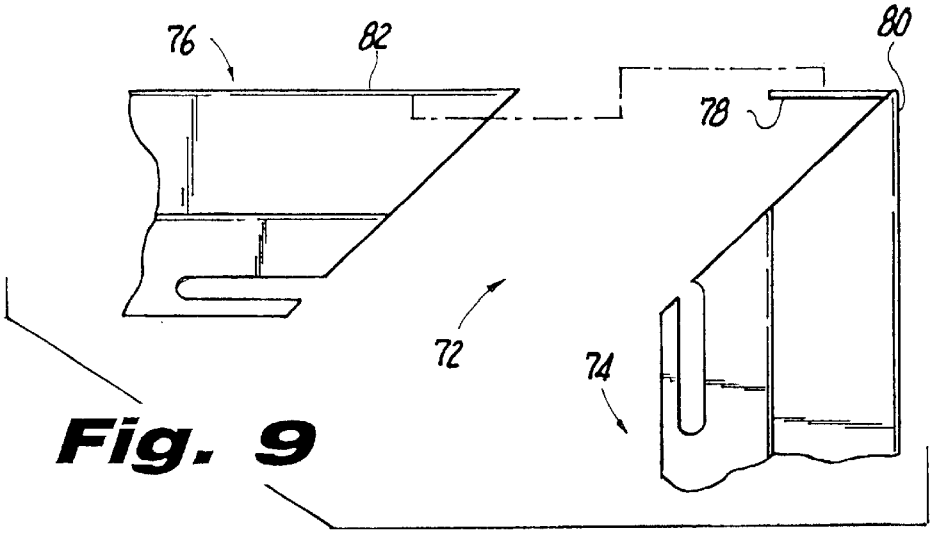
FIG. 9 is a front view of two mitered pieces of J-channel trim being assembled to make an inside J-channel frame.

FIG. 9 shows a mitered joint 72 of an inside J-channel frame which was marked utilizing an embodiment of the present invention, for example, gauge 10. Similar to the mitered joint 64 in FIG. 8, both pieces of J-channel trim 74 and 76 have mitered cuts; however, the mitered cuts are formed in an opposite direction and J-channel trim 74 includes an interlocking tab 78 that extends from its bottom side 80 and slides along the bottom side 82 of mitered J-channel trim 76 when assembled.

Figure 10:
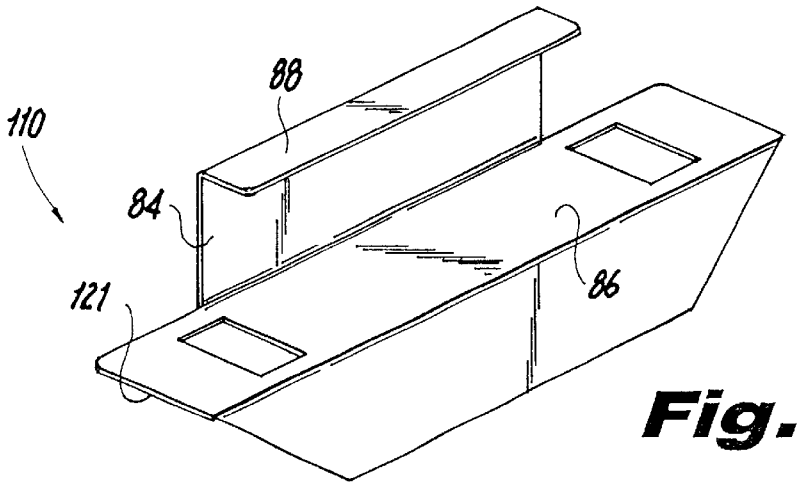
FIG. 10 is an isometric view of an alternate embodiment of a depth and miter gauge made in accordance with the present invention.

Other embodiments of the depth and miter gauge may be made without departing from the spirit and scope of the present invention. For example, FIG. 10 shows a gauge 110 made in accordance with the present invention and adapted for ease of use and comfort for holding. Gauge 110 is similar to gauge 10, however, instead of flange 16, gauge 110 includes a flange having a first portion 84 extending perpendicularly from a web 86 and a second portion 88 extending perpendicularly from the first portion 84. The first and second portions 84 and 88 are configured to allow a user to more readily grip the gauge 110 during use. Additionally, the first and second portions 84 and 88 are configured for use in marking one or more straight lines on J-channel trim.

A alternate embodiment of the present invention may include a stop for positioning the end of a web flush with the end of a piece of trim. For example, gauges 10 or 110 may have a stop bar (not shown) permanently or adjustably attached to ends 21 or 121, respectively, such that the gauge can be located flush to the end of a piece of J-channel trim.

Those skilled in the art will appreciate that an embodiment of the present invention may be made sufficiently compact so that a user may conveniently clip it to a tool pouch, hang it on a belt clip, or tuck it into a shirt or pants pocket. This feature of the present invention is advantageous in that the user's hands will remain unencumbered while climbing ladders, handling other tools, or traversing scaffolding. Furthermore, an embodiment of the present invention may be made sufficiently small to permit a user to grasp it and a piece of J-channel trim in one hand so that the user will have a free hand to apply marks to J-channel trim.

While the device disclosed herein has been described with respect to various specific embodiments, those skilled in the art will readily appreciate that various modifications, changes, and enhancements that were not specifically disclosed herein may be made thereto without departing from the spirit and scope of the present invention as defined by the appended claims.

What is claimed is:

1. A depth and miter gauge for marking trim, comprising:

a web having a first slot defining a first edge adjacent a first end of the web for making depth markings on the trim; and a first flange extending approximately perpendicularly from a first side of the web along a line of intersection, and having a first angled mitered edge on a first end and a second angled mitered edge on a second end for making miter markings on the trim;

wherein said first edge of said first slot is substantially parallel to said first end of said web and substantially perpendicular to said line of intersection.

2. A depth and miter gauge as recited in claim 1, wherein the first edge is spaced about 0.75 inch from the first end of the web.

3. A depth and miter gauge as recited in claim 1, wherein the first edge is spaced about 1.15 inches from the first end of the web.

4. A depth and miter gauge as recited in claim 1, wherein the first and second mitered edges are angled approximately 45 degrees relative to the first side of the web.

5. A depth and miter gauge as recited in claim 1, further comprising a second slot defining a second edge adjacent a second end of the web for making depth markings on the trim.

6. A depth and miter gauge as recited in claim 1, further comprising a second flange extending approximately perpendicularly from a second side of the web in a direction opposite the first flange and having a mitered edge on a first end for making miter markings on the trim.

7. A depth and miter gauge as recited in claim 6, wherein the second flange has a mitered edge on a second end for making miter markings on the trim.

8. A depth and miter gauge for marking trim, comprising:

a web having a first slot adjacent a first end of the web defining first and second opposing edges that are substantially parallel to the first end of the web for making depth markings on the trim; and a first flange extending substantially perpendicularly from a first side of the web along a line of intersection, and having a first end angled acutely relative to the first side of the web;

wherein said first edge of said first slot is substantially perpendicular to said line of intersection.

9. A depth and miter gauge as recited in claim 8, wherein the first end of the first flange is angled approximately 45 degrees relative to the first side of the web.

10. A depth and miter gauge as recited in claim 8, wherein the web has a second slot adjacent a second end of the web defining third and forth opposing edges that are substantially parallel to the second end of the web for making depth markings on the trim, and wherein the first flange has a second end angled acutely relative to the first side of the web.

11. A depth and miter gauge as recited in claim 10, wherein the first end and the second end of the first flange are angled approximately 45 degrees relative to the first side of the web.

12. A depth and miter gauge as recited in claim 10, wherein the first and the second opposing edges are approximately 0.75 inch and 1.15 inches, respectively, from the first end of the web and the third and fourth opposing edges are approximately 0.75 inch and 1.15 inches, respectively, from the second end of the web.

13. A depth and miter gauge as recited in claim 8, further comprising a second flange extending approximately perpendicularly from a second side of the web in a direction opposite the first flange and having a first end angled acutely relative to the second side of the web.

14. A depth and miter gauge as recited in claim 13, wherein the second flange has a second end angled acutely relative to the second side of the web.

15. A depth and miter gauge as recited in claim 8, further comprising a second flange extending approximately perpendicular to a second side of the web and having first and second ends each angled perpendicularly relative to the second side of the web.

16. A depth and miter gauge as recited in claim 15, further comprising a third flange extending approximately perpendicularly from the second flange.

17. A depth and miter gauge for marking trim, comprising:

a web having a first slot defining a first edge and a second edge that are approximately 0.75 inch and 1.15 inches, respectively, from a first end of the web, and a second slot defining a third edge and a fourth edge that are approximately 0.75 inch and 1.15 inches, respectively, from a second end of the web, for making depth markings on the trim; and a first flange extending substantially perpendicularly from a first side of the web and having first and second ends each angled approximately 45 degrees relative to the first side of the web for making miter markings on the trim.

18. A depth and miter gauge as recited in claim 17, further comprising a second flange extending substantially perpendicularly from a second side of the web and having first and second ends each angled approximately 45 degrees relative to the second side of the web for making miter markings on the trim.

19. A method for making mitered joints on J-channel trim, comprising:

providing a depth and miter gauge including a web having a slot defining a first edge adjacent an end of the web for making depth markings on the trim, and a first flange extending approximately perpendicularly from a first side of the web and having a mitered edge on its first end for making miter markings on the trim;

placing the web on a base of the trim and the end of the web flush with an end of the trim;

making a mark on the base of the trim along the first edge of the gauge;

placing the first flange on a front leg of the trim and the end of the web flush with the end of the trim;

making a mark on the front leg of the trim along the mitered edge of the gauge; and removing portions of the trim using the marks for guidance to create a mitered joint on the trim.

20. A method as recited in claim 19, further comprising placing the first flange on the rear leg of the trim and the end of the web flush with the end of the trim, and making a mark on the rear leg of the trim along the mitered edge of the gauge.

* * * * *